United States Patent [19]

Goineau

[11] Patent Number: 4,851,643

[45] Date of Patent: Jul. 25, 1989

[54] DRAW BLOCK

[75] Inventor: Andre Marie Goineau, Spartanburg, S.C.

[73] Assignee: Milliken Research Corporation, Spartanburg, S.C.

[21] Appl. No.: 101,304

[22] Filed: Sep. 24, 1987

Related U.S. Application Data

[62] Division of Ser. No. 71,292, Jul. 9, 1987, Pat. No. 4,736,500.

[51] Int. Cl.[4] ..... H05B 3/42

[52] U.S. Cl. ..... 219/388; 432/59

[58] Field of Search ..... 219/388, 390, 388 S; 28/240, 245, 246; 432/59; 57/310

[56] References Cited

U.S. PATENT DOCUMENTS

| | | | |
|---|---|---|---|
| 2,803,109 | 8/1957 | Stoddard | 219/388 |
| 2,820,876 | 1/1958 | VanDijk | 432/59 |
| 2,891,375 | 6/1959 | Vandamme | 219/388 |
| 3,108,323 | 10/1963 | Sikorski | 264/290.7 |
| 3,376,698 | 4/1968 | Whittaker | 28/240 |
| 3,404,441 | 10/1968 | Manabe | 219/10.49 R |
| 3,562,369 | 2/1971 | Chopra | 28/245 |
| 3,626,558 | 12/1971 | Parker | 219/388 |
| 3,969,800 | 7/1976 | Baldini | 28/246 |
| 3,999,360 | 12/1976 | Forin | 432/59 |
| 4,217,323 | 8/1980 | Foster | 264/235 |
| 4,255,134 | 3/1981 | Schippers | 432/59 |
| 4,293,518 | 10/1981 | Bethay | 264/210.2 |
| 4,318,210 | 3/1982 | Foster | 28/246 |
| 4,485,063 | 11/1984 | Good | 264/235.6 |

FOREIGN PATENT DOCUMENTS

| | | |
|---|---|---|
| 49-124355 | 11/1974 | Japan . |
| 1299892 | 12/1972 | United Kingdom . |

*Primary Examiner*—Teresa J. Walberg

*Attorney, Agent, or Firm*—Earle R. Marden; H. William Petry

[57] ABSTRACT

An air texturing system for partially oriented yarn in which a draw block of aluminum or other suitable material is employed to provide two stages of drawing for the yarn to be textured. The draw block has an inlet offset from the outlet to provide for one stage of drawing between the inlet and outlet of the draw block.

3 Claims, 1 Drawing Sheet

DRAW BLOCK

This is a division of application Ser. No. 071,292, filed July 9, 1987 now U.S. Pat. No. 4,736,500.

This invention relates generally to an air texturing system for the drawing and texturing of a partially oriented synthetic yarn (POY) which eliminates the use of a hot draw pin.

In particular, the invention is directed to the use of a new and novel heated draw block to provide two stages of drawing for a POY yarn which is to be textured.

It is therefore an object of the invention to provide a new and novel draw block for POY yarn which eliminates the disadvantages of a heated pin in the drawing process.

Other objects of the invention will become readily apparent as the specification proceeds to describe the invention with reference to the accompanying drawing, in which.

Figure 1:
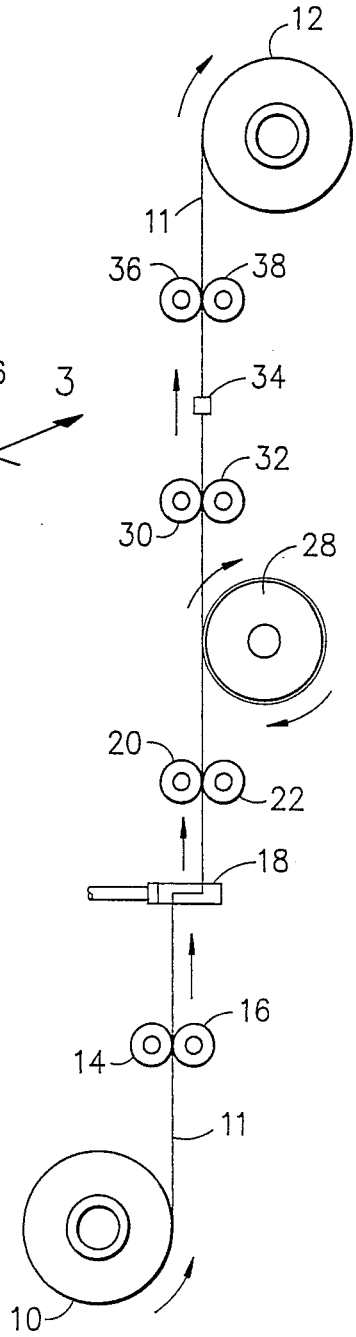
FIG. 1 is a schematic representation of the new and improved air texturing system.

Looking now to the drawings and especially FIG. 1, the invention will be described. The reference number 10 represents a yarn package of DuPont 240/54-693T POY yarn which is to be drawn, textured and taken up as 1/150/54-693T yarn on the package 12. The yarn 11 is delivered by the rolls 14, 16 to the draw block 18, heated to about 100°C., at the rate of approximately 250 meters/minute. Since the rolls 20, 22 are delivering yarn 11 at a rate of approximately 445 meters/minute the draw block 18 provides two stages of drawing. One stage of drawing is between the ceramic inlet guide 24 and the ceramic outlet guide 26 and the second stage is between the outlet guide 26 and the rolls 20, 22. From the rolls 20, 22 the drawn yarn is wrapped around the pin 28, heated to a temperature of about 140°C., and allowed to relax since the rolls 30, 32 are delivering yarn at a rate of 430 meters/minute. From the rolls 30, 32 the yarn 11 passes through a conventional air texturing nozzle 34, operating with air at a pressure of 140 p.s.i., wherein it is air textured. From the air texturing jet the yarn 11 is delivered to the take-up package 12 by the rolls 36, 38 driven at a suitable desired speed.

Figure 2:
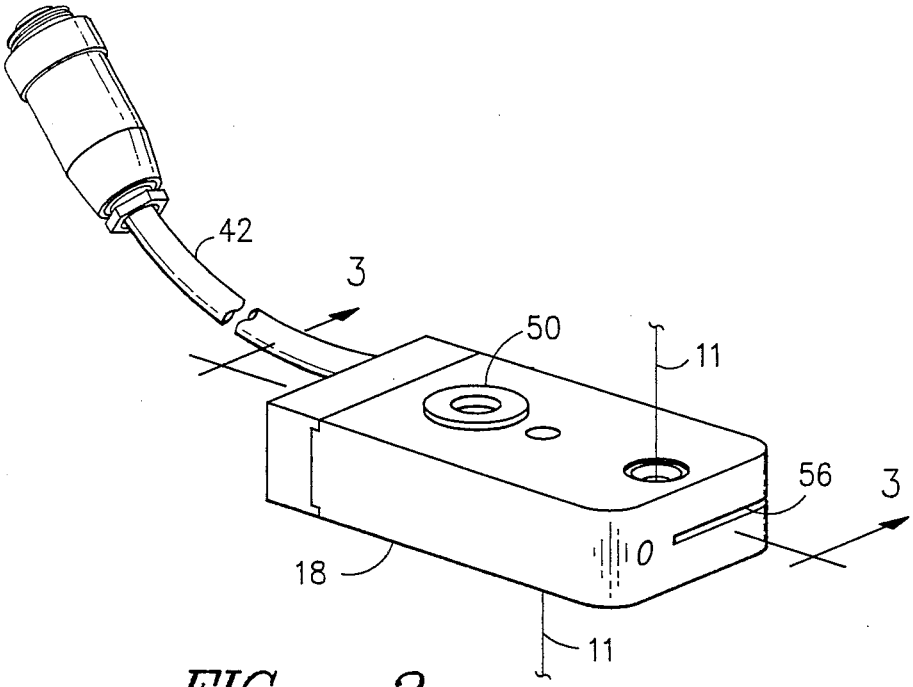
FIG. 2 is a blown-up view of the draw block used in the system of FIG. 1.
Figure 3:
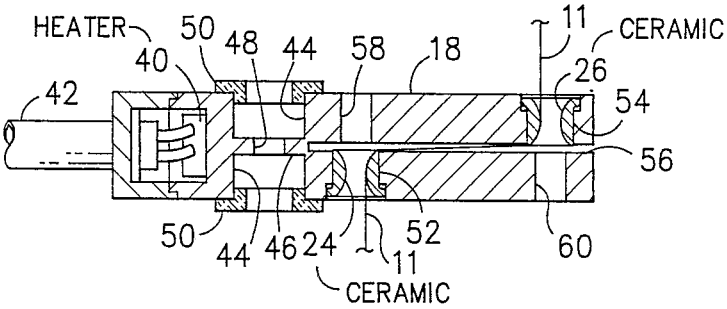
FIG. 3 is a cross-sectional view taken on line 3—3 of FIG. 2.

The draw block 18, shown in detail in FIGS. 2 and 3, is basically a metal block, preferably of aluminum, heated by an electrical heater 40 connected to a suitable source of electricity by the connector 42. Adjacent the heater 40 are drilled cavities 44 to provide a shelf 46 with a hole 48 therein. The hole 48 along with perforated inserts 50 are useful to mount the draw block 18 on the texturing machine.

As mentioned previously, ceramic inserts 24 and 26 are provided in the openings 52 and 54, respectively, to guide the yarn through the slot 56 from the inlet guide 24 to the outlet guide 26. Opposite the ceramic inserts 24 and 26, respectively, are holes 58 and 60 to allow the inserts 24 and 26 to be knocked out and replaced and to aid in the thread-up of the yarn through the draw block 18. As described previously one stage of drawing is accomplished in the slot 56 between the inlet guide 24 and the outlet guide 26 while the second stage of drawing is performed between the outlet guide 26 and the rolls 20, 22.

Figure 4:
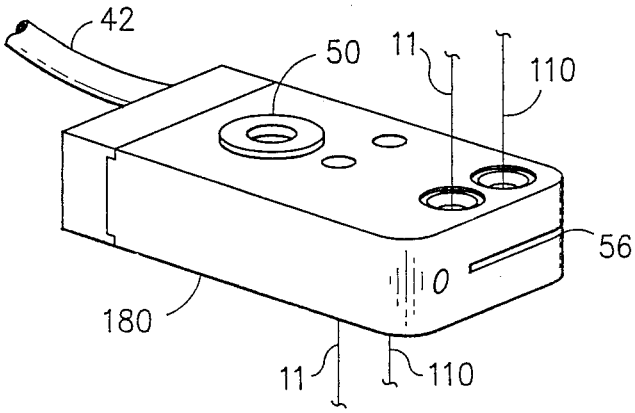
FIG. 4 is a view similar to FIG. 2 showing a modification of FIGS. 1-3 when two supply yarns are being run.

The modification of FIG. 4 illustrates the passage of two POY yarns 11 and 110 through a draw block 180 modified to provide an additional inlet and outlet for the passage of an additional yarn 110.

It can readily be seen that the new and improved draw block allows for efficient two-stage drawing of a POY yarn in an air texturing system. This system is particularly useful when texturing abrasive yarns which cause detrimental wear on a conventional hot draw pin. The draw block with the ceramic guides provides considerable longer service life before it is necessary to shut down the system to replace the ceramic guide members.

Although the preferred embodiments of the invention have been described specifically, it is contemplated many changes may be made without departing from the scope or spirit of the invention and it is desired that the invention be limited only by the claims.

I claim:

1. A draw block for heating and drawing a synthetic yarn comprising: an elongated metal housing, means to supply heat to said housing, a yarn inlet in said housing, a yarn outlet in said housing and means forming an elongated slot in said housing substantially perpendicular to the centerlines of and communicating with said yarn inlet and said yarn outlet.

2. The draw block of claim 1 wherein a ceramic guide member is located in said yarn inlet and in said yarn outlet.

3. The draw block of claim 2 wherein a knock-out hole is provided in said housing opposite to said ceramic guide members to provide access thereto for replacement of said ceramic members.

* * * * *